United States Patent [19]

Ashworth et al.

[11] Patent Number: 4,813,156

[45] Date of Patent: Mar. 21, 1989

[54] PAPERMACHINE AND LIKE FABRICS

[75] Inventors: Timothy N. Ashworth, Blackburn; Brian G. Littler, Hoddlesden, both of England

[73] Assignee: Scapa-Porritt Limited, Blackburn, England

[21] Appl. No.: 944,065

[22] Filed: Dec. 22, 1986

[30] Foreign Application Priority Data

Dec. 21, 1985 [GB] United Kingdom ..... 8531540

[51] Int. Cl.[4] ..... F26B 13/10

[52] U.S. Cl. ..... 34/116; 34/123

[58] Field of Search .....:. 34/116, 123, 110, 243 R; 139/383 A

[56] References Cited

U.S. PATENT DOCUMENTS 4,202,113 5/1980 Kankaanpaa ..... 34/116

4,494,319 1/1985 Rudt ..... 34/123

*Primary Examiner*—Henry A. Bennet

*Attorney, Agent, or Firm*—Fleit, Jacobson, Cohn & Price

[57] ABSTRACT

In order to reduce the adverse effects of overpressure on a paper sheet existing at the outer face of a dryer fabric moving in contact with a dryer cylinder in the dryer section of a paper machine, it is proposed to provide void-spaces at the fabric-cylinder interface, or the equivalent, arranged in fluid flow connection with that space in which boundary air moving with the fabric towards the position of engagement of the fabric with the cylinder is progressively compressed, as the fabric moves into contact with the cylinder.

7 Claims, 3 Drawing Sheets

PAPERMACHINE AND LIKE FABRICS

The invention concerns papermachine and like fabrics, and has particular, though not exclusive, reference to fabrics for use in the dryer section of a papermaking or like machine.

One problem met with in the operation of a high speed papermaking machine, and particularly in the early dryer sections, especially on the Uno-run configuration, of such machine, is that of separation of the paper sheet from the dryer fabric as the fabric and exposed paper sheet move from a top to a bottom cylinder. As the fabric and paper sheet leave the upper cylinder, the increasing transverse cross-section of the space between the fabric and top cylinder gives rise to a suction force which tends to lift the paper sheet from the dryer fabric, the suction force increasing with increase in the linear speed of the fabric. At a later stage, and more particularly as the fabric and paper sheet move into contact with the bottom cylinder, the reducing transverse cross-section of the space between such latter cylinder and the fabric results in a progressive increase in the pressure of the boundary layer of air existing at the back of the fabric, the resultant overpressure forcing air through the fabric and again serving to lift the paper sheet from such fabric.

In addition to the adverse effect of overpressure on separation, centrifugal forces also act on the exposed paper sheet as it is not supported on the bottom cylinder. In an endeavour to reduce the creation of an overpressure, it is conventional practice to include a blow box in the angle between the dryer fabric and bottom cylinder, the blow box operating to move air from such region, thus reducing the extent to which air is forced through the dryer fabric and hence militating against fabric/sheet separation.

The present invention is concerned with the reduction of the adverse effect of the overpressure as aforesaid, and proposes a method of drying a paper or like sheet on its passage through the dryer section of a papermaking machine wherein the sheet moves in contact with a dryer fabric during passage, successively, between and around the individual ones of an array of dryer cylinders, characterised by the step of creating a void-space at the cylinder/fabric interface, said void-space being downstream of and in fluid-flow connection with that reducing space existing between the fabric and cylinder immediately preceding engagement of the fabric with the cylinder.

In accordance with the invention it is also proposed that the papermachine or like clothing be adapted and arranged to define, in conjunction with the cylinder or roller about which the same extends, a void-space to receive, at least in part, the boundary air compressed between the clothing and the cylinder/roller on movement of the clothing into engagement therewith.

In a preferred arrangement the void-space forming surface includes spaced parallel ribs defining grooves therebetween, the void-space constituted by said grooves effectively reducing the rate at and extent to which boundary air moving into the reducing space between the fabric and bottom cylinder/roller is compressed and having a corresponding effect on the amount of air forced through the fabric.

In an alternative arrangement a supplementary fabric having a void-space defining surface configuration intended for engagement with the bottom cylinder/roller is proposed, the dryer fabric moving in contact with the supplementary fabric. The supplementary fabric may be in the form of a sleeve applied to the cylinder/roller, may comprise an endless band movable with the dryer fabric over a relevant part only of its run, or may be of similar length to the dryer fabric and move in conjunction therewith through the full extent of its run.

The invention will now be described further, by way of example only, with reference to the accompanying diagrammatic drawings in which.

Figure 1:
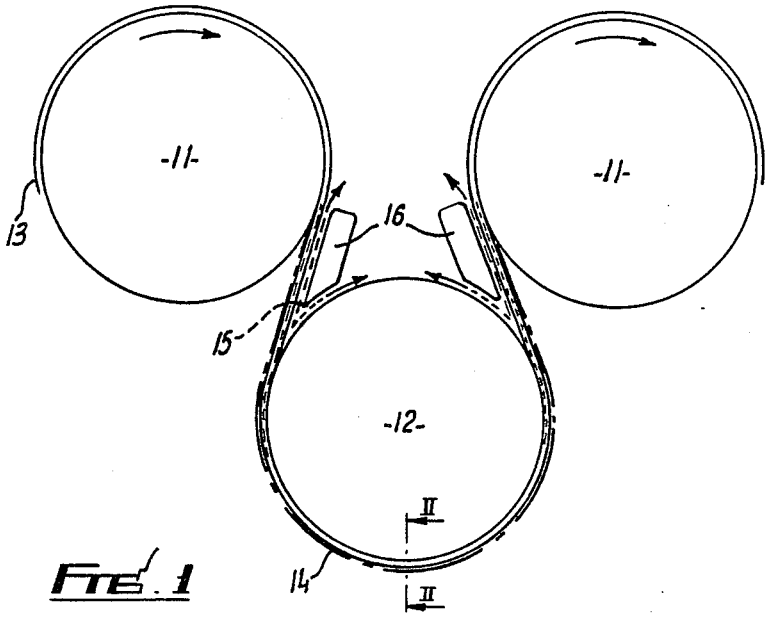
FIG. 1 is a side elevation of a part of the dryer section of a papermaking machine, and shows the path of the dryer fabric, and paper sheet thereon, in moving between top and bottom cylinders.

Referring now to the drawings, and particularly to FIG. 1 thereof, the dryer section of a papermaking machine comprises a series of upper and lower cylinders 11, 12, the dryer fabric 13 passing successively between the top and bottom such cylinders in moving through the dryer section. It will be appreciated that the paper sheet 14 lies between the dryer fabric 13 and the top cylinders 11 but lies radially outwardly of the fabric 13 as the same passes around the bottom cylinders 12. It will also be appreciated that there is a boundary layer of air moving in contact with the exposed surface of the fabric.

As the dryer fabric 13 moves towards and into engagement with the bottom cylinder 12, the boundary layer of air at the cylinder contacting face of the fabric passes into a region 15 of reducing transverse cross-section, the pressure of such air increasing and such air being forced through the dryer fabric 13 to lift the paper sheet 14 from contact therewith, the adverse effect of the overpressure being worsened by centrifugal forces acting on the paper sheet.

Blow boxes 16 are provided in region 15, the blow boxes serving to remove air from such region and thus reduce the extent to which air is forced through the dryer faric. Whilst such blow boxes 16 have proved effective, they do not wholly eliminate the problem, especially at very high machine speeds, and separation of the paper sheet still occurs.

The present invention proposes the creation of a void-space or spaces between the dryer fabric and bottom cylinder, thus to reduce the extent to which the boundary air is compressed, the presence of the void-space or spaces having a corresponding effect on the amount of air forced through the dryer fabric.

Figure 2:
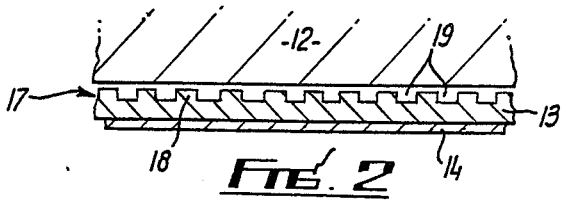
FIG. 2 is a section on line II—II of FIG. 1, drawn to a much enlarged scale, and illustrates the ribbed surface configuration of the dryer fabrics.

Referring now to FIG. 2, the non-paper side 17 of the dryer fabric is, in accordance with the invention, provided with a multiplicity of spaced machine-direction ribs 18 which form channels therebetween, the fabric 13 and bottom cylinder 12 combining to define void-spaces 19 into which the boundary layer air can be compressed, rather than being forced through the dryer fabric.

If present in the context of a dryer section provided with blow boxes 16, the void-spaces 19 not only reduce the extent of the overpressure but also effectively increase the working area of the blow boxes 16, since air can be withdrawn from the void-spaces 19 by the blow boxes after the dryer fabric 13 has moved into contact with the bottom cylinder 12.

Figure 3:
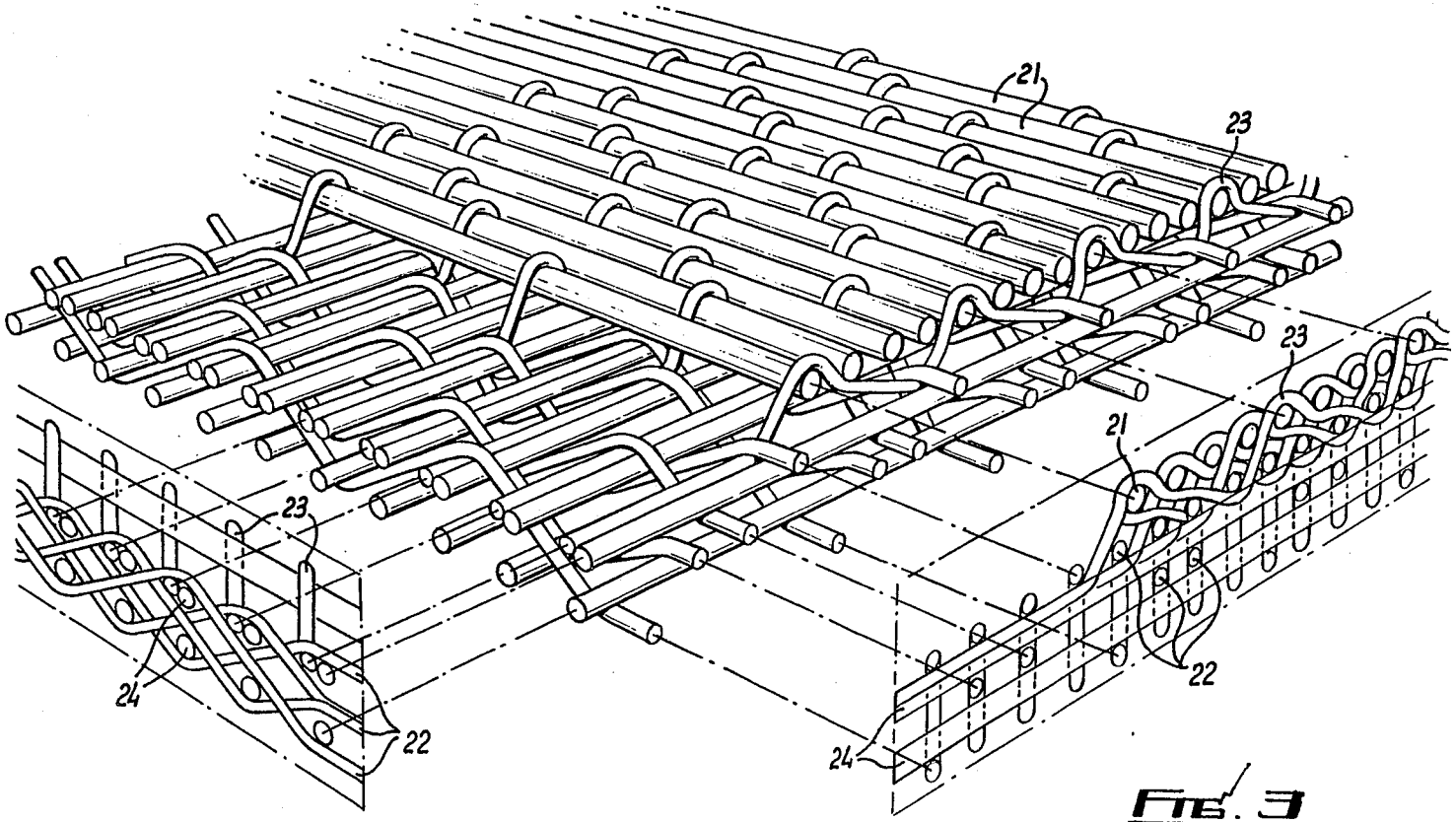
FIG. 3 is a schematic drawing of a dryer fabric having a ribbed surface configuration and suitable for use in the context of the arrangement shown in FIG. 1 and 2.

In one particular arrangement it is proposed that the weave structure of a conventional dryer fabric be modified by the conclusion of machine direction yarns at the intended non-paper side of the fabric, the additional machine direction yarns, whether provided singly or in groups, existing in spaced apart, parallel disposition at the surface of the fabric and being bound to the fabric at intervals by additional cross-machine direction yarns or by the cross-machine direction yarns of the existing weave structure. A typical such arrangement is shown in FIG. 3 of the accompanying drawings, the additional machine direction yarns 21 being monofilaments of a larger diameter than the machine direction yarns 22 of the existing weave structure, and being bound to the body of the dryer fabric by cross-machine direction yarns 23 additional to the cross machine direction yarns 24 of the dryer fabric.

Figure 4:
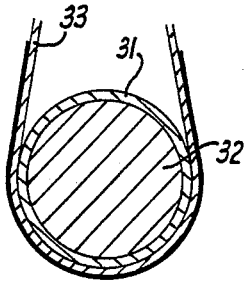
FIG. 4 is a side elevation of a part of the dryer section of a papermaking machine, and shows an alternative to the ribbed surface configuration of the dryer fabric in providing void spaces to receive boundary air.
Figure 5:
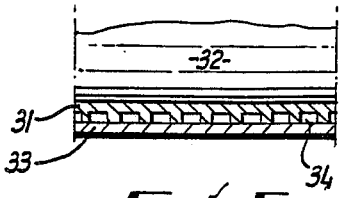
FIG. 5 is a section on line V—V of FIG. 4, drawn to a larger scale.

An analogous effect can be achieved by providing a textile or other sleeve 31 about the bottom cylinder 32, see now FIGS. 4 and 5, such sleeve 31 having a ribbed outer surface to cooperate with a conventional dryer fabric 33 in defining void-spaces 34 as aforesaid. Alternatively, it may be found practical simply to provide apertures in the sleeve to accomodate the boundary air.

Further possibilities are illustrated in FIGS. 6 to 9.

Figure 6:
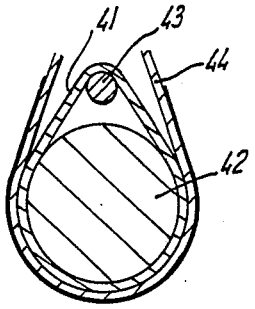
FIG. 6 is a side elevation corresponding to FIG. 4, and shows a further alternative to the ribbed surface configuration of the dryer fabric in providing void spaces to receive boundary air.
Figure 7:
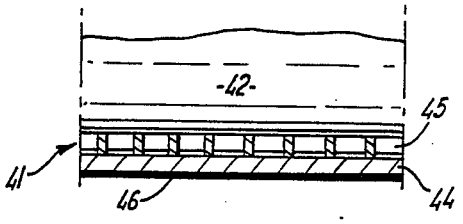
FIG. 7 is a section on line VII—VII of FIG. 6, drawn to a larger scale.

In the embodiment shown in FIGS. 6 and 7, a supplementary fabric 41 in graticule form, extends about the bottom cylinder 42 and a hitch roll 43, arranged parallel thereto, the supplementary fabric 41 holding the dryer fabric 44 in spaced apart disposition relative to the dryer cylinder 42.

The cross-machine direction elements 45 of the supplementary fabric may be of the same or of a lesser dimension in the radial direction of the cylinder than the machine direction elements 46, as preferred.

Figure 8:
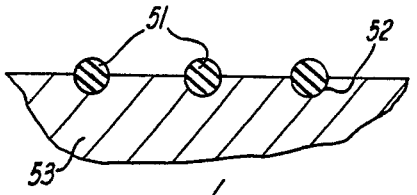
FIG. 8 is a view corresponding in part to FIG. 7 and shows a still further alternative way in which to create void spaces between a dryer fabric and bottom cylinder.

An alternative to the arrangement of FIGS. 6 and 7 is shown in FIG. 8, and comprises spaced bands 51, engaged with respective grooves 52 in the surface of the hitch roll 53.

In an alternative to the arrangement illustrated by FIG. 8, a plurality of bands may be applied to the cylinder in axially spaced disposition thereon.

Figure 9:
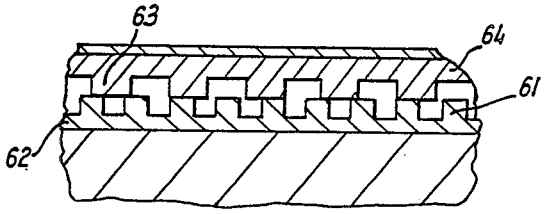
FIG. 9 is a view corresponding to FIG. 2 and 5, and shows the void space forming means respectively shown therein used in combination.

A still further alternative contemplates a sleeve generally of the kind shown in FIG. 4 in combination with a ribbed dryer fabric of the kind illustrated by FIG. 2, the dimension and pitch of the individual ribs as respectively provided on the sleeve and fabric being such as to preclude meshing of the two in the radial direction of the cylinder. This particular proposal is illustrated in FIG. 9, the ribs 61 on the sleeve 62 being smaller and at closer centres than the ribs 63 on dryer fabric 64.

What is claimed is:

1. Papermachine clothing for supporting a moist web in its passage around dryer cylinders of a papermaking machine, said papermachine clothing comprising:

a dryer fabric movable about a dryer cylinder and a supplementary fabric movable with said dryer fabric about the dryer cylinder on an opposite side of said dryer fabric from the moist web, said supplementary fabric having a void-space defining surface configuration and being engageable with the dryer cylinder to receive, at least in part, boundary air progressively compressed between said dryer fabric and the dryer cylinder on movement of said dryer fabric about the dryer cylinder.

2. A dryer fabric for supporting a moist web in the dryer section of a papermaking machine having an array of dryer cylinders about which the fabric extends, said dryer fabric comprising:

machine direction and cross machine direction yarns woven together to form a coherent structure, the additional machine direction yarns bound at a surface of the coherent structure in spaced-apart, parallel disposition to define ribs projecting from said surface, said ribs forming grooves therebetween which extend in said machine direction and which form, in conjunction with the dryer cylinder about which the dryer fabric extends, void spaces to receive, at least in part, boundary air progressively compressed between the dryer fabric and the dryer cylinder on movement of the fabric into engagement with the dryer cylinder.

3. Papermachine clothing as claimed in claim 1, wherein said void-space defining surface exists at a face of said supplementary fabric remote from said dryer fabric.

4. Papermachine clothing as claimed in claim 3, wherein said supplementary fabric is coextensive with said dryer fabric in the machine direction thereof.

5. Papermachine clothing as claimed in claim 1, wherein said void-space defining face of said supplementary fabric exists at a face of said supplementary fabric engaging said dryer fabric.

6. Papermachine clothing as claimed in claim 1, wherein said supplementary fabric comprises a sleeve engaged with a dryer cylinder.

7. A dryer section as claimed in claim 1, wherein said void-space forming surface includes spaced parallel ribs defining grooves therebetween, a void-space formed by said grooves effectively reducing the rate at and extent to which the boundary air moving into a reducing space between said dryer fabric and the dryer cylinder is compressed and having a corresponding effect on the amount of air forced through said dryer fabric.

* * * * *